United States Patent [19]

Roberts et al.

[11] Patent Number: 4,815,685

[45] Date of Patent: Mar. 28, 1989

[54] SHELF ASSEMBLY

[75] Inventors: John J. Roberts; Richard A. Stich, both of Louisville, Ky.; John M. Powell, Charlestown, Ind.; Gerhard K. Losert, Venice, Fla.

[73] Assignee: General Electric Company, Louisville, Ky.

[21] Appl. No.: 112,463

[22] Filed: Oct. 26, 1987

[51] Int. Cl.[4] ..... A45B 57/04

[52] U.S. Cl. ..... 248/221.3; 24/297; 248/225.1; 248/235

[58] Field of Search ..... 248/221.3, 225.1, 224.4, 248/221.4, 222.1, 223.1, 231.8, 73, 27.3, 235; 312/138 A; 24/297, 453, 616

[56] References Cited

U.S. PATENT DOCUMENTS

| | | | |
|---|---|---|---|
| 3,402,907 | 9/1968 | Fisher | 248/216 |
| 3,647,075 | 3/1972 | Aue | 211/153 |
| 3,652,032 | 3/1972 | Eros et al. | 248/235 |
| 3,765,344 | 10/1973 | Ferdinand et al. | 108/108 |
| 3,844,000 | 10/1974 | Hedu | 24/230 |
| 3,954,242 | 5/1976 | Yoda | 248/221.4 X |
| 4,334,659 | 6/1982 | Yuda | 248/221.4 X |
| 4,408,914 | 10/1983 | Ciesiel et al. | 248/27.3 X |
| 4,411,401 | 10/1983 | Anderson | 248/262 |
| 4,506,419 | 3/1985 | Mitomi | 24/297 |
| 4,508,301 | 4/1985 | Nicholson et al. | 248/250 |
| 4,532,682 | 8/1985 | Murao | 24/616 |
| 4,712,341 | 12/1987 | Harris, Jr. et al. | 24/297 X |

*Primary Examiner*—Alvin C. Chin-Shue

*Attorney, Agent, or Firm*—Frederick P. Weidner; Radford M. Reams

[57] ABSTRACT

A shelf assembly including a panel forming a shelf with a back wall, bottom wall and side walls and having an elongated front shelf member and an end cap holding the shelf front member to each side wall of the shelf. The end cap has a base wall with perpendicular integrally formed rear, side and front flanges and the base wall has at the front thereof projections for securing thereto one end of the shelf front member. The end cap has a latching assembly secured to the rear flange and projecting rearwardly and receivable in an aperture in the panel side wall and includes two support legs each having a width slightly less than the distance between opposite edges of the side wall aperture. A spring member is located between the legs and attached to both support legs at one end away from the rear flange and the distal end of the spring member is free. The spring member has an inclined ramp portion extending from the attached end toward the rear flange and extends outside the diameter of the aperture in the panel. The spring member also has a panel engaging portion depending from the ramp portion in a direction of the leg at an inclined angle with the rear surface of the panel side wall of between 95 and 160 degrees. With the spring member being depressed and inserted into the aperture the rear flange abuts one side of the panel and the panel engaging portion of the spring member is biased against only the rear surface of the panel side wall to secure the end cap to the panel and the end cap is removable therefrom by depressing the spring member and withdrawing the end cap from the aperture.

8 Claims, 3 Drawing Sheets

SHELF ASSEMBLY

BACKGROUND OF THE INVENTION

The present invention relates to a shelf assembly and more particularly to a shelf assembly for use in connection with household refrigerator doors.

It is common in household refrigerators to have the access doors inner panel formed to provide shelves for storage of food containers and beverage bottles. At the front of the shelf there are rails or shelf front members that extend across the front of the shelf to prevent the food containers and beverage bottles from falling out of the shelves at the front of the inner panels. It is desirable that these shelf front members which extend from one side of the inner door to the other side of the inner door be firmly secured to the door so that they remain in place especially when the door is closed abruptly so that the inertia of the food containers and beverage bottles do not detach the shelf front member from the door and thereby fall off the shelf and perhaps even cause breakage of the bottles.

It is also desirable that the shelf front members and the end caps holding the members securely to the refrigerator door be easily removable by the user for purposes of cleaning. Therefore, in the case of the end caps holding the shelf front member, it is desirable that they hold the member firmly in place yet be easily removable from the refrigerator door. It is also desirable that endcaps be insertable with a straight unidirectional motion to obtain minimuim assembly time and therefore less manufacturing cost. By this invention these desirable characteristics are provided.

SUMMARY OF THE INVENTION

A shelf front assembly comprising a panel forming a shelf with a back wall, bottom wall and side walls and having an elongated front shelf member and an end cap holding the shelf front member to each side wall of the shelf. The end cap has a base wall with perpendicular integrally formed rear, side and front flanges depending there from in the same direction and said base wall has at the front thereof means to secure one end of the shelf front member. The end cap has a latching assembly secured to the rear flange and projecting rearwardly there from and receivable in an aperture in the panel side wall. The latch assembly includes two support legs each having a width slightly less than the distance between opposite edges of the panel side wall aperture. The latch assembly also includes a spring member located between the legs and attached to both support legs at one end thereof away from the rear flange and the distal end of the spring member is free. The spring member has an inclined ramp portion extending from the attached end toward the rear flange and extends outside the diameter of the aperture in the panel. The spring member also has a panel engaging portion depending from the ramp portion in the direction of the leg at an included angle with the rear surface of the panel side wall of between 95 and 160 degrees. With the spring member being depressed and inserted into the panel side wall aperture, the rear flange of the end cap abuts one side of the panel and the panel engaging portion of the spring member is biased against only the rear surface of the panel side wall applying forces rearwardly and laterally relative to the rear surface to secure the end cap to the panel side wall. The end cap may be removed from the panel side wall by depressing the spring member and withdrawing the end cap from the aperture.

DESCRIPTION OF THE PREFERRED EMBODIMENT

Figure 1:
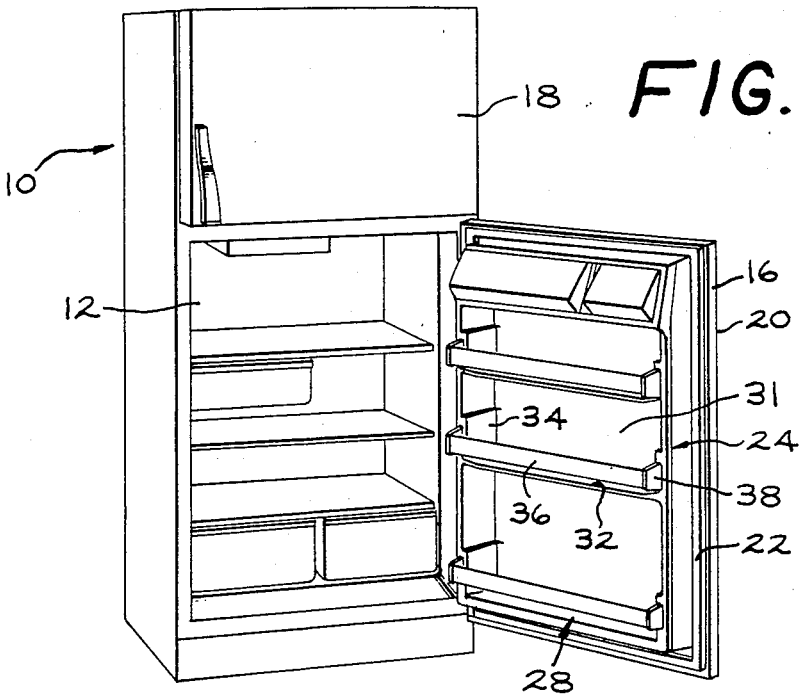
FIG. 1 is a perspective view of a refrigerator with an access door open and incorporating the present invention.
Figure 3:
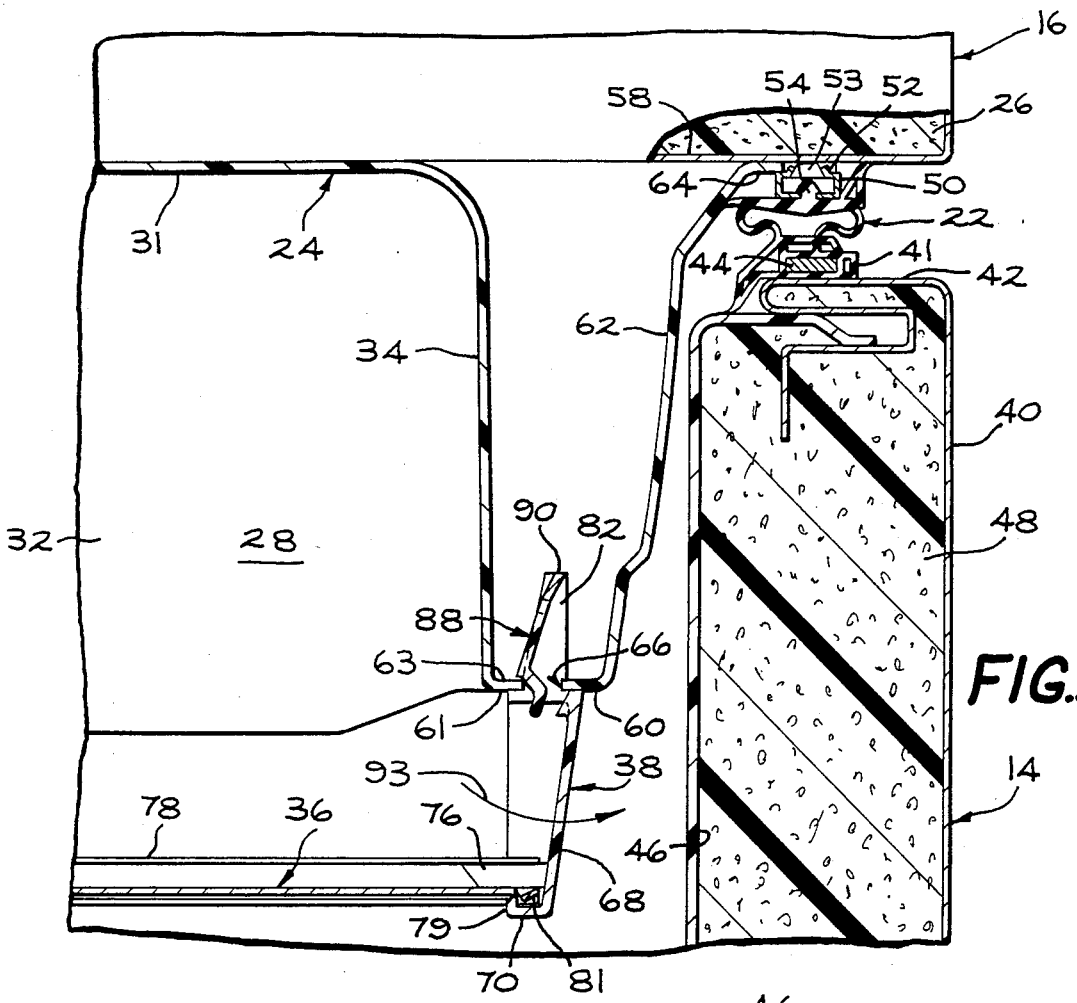
FIG. 3 is a top plan view in section showing the shelf front assembly of the present invention.

With reference to FIG. 1, there is shown a household refrigerator 10 having a fresh food compartment 12 located in the embodiment shown below a freezer compartment and the fresh food compartment has an access door 16 and the upper freezer compartment has a door 18. The fresh food door 16 has an outer metal shell 20 having a gasket 22 around the periphery of the door 16 which acts to seal the fresh food compartment 12 from air leakage when the door is closed. There is an inner door panel 24 usually formed from plastic material which is secured around the periphery thereof to the outer metal shell 20. Between the inner door panel 24 and the outer metal shell 20 there is a layer of thermal insulation 26 (FIG. 3). The inner door panel 24 is formed with one or more shelves 28 that have a back wall 31, a bottom wall 32, and side walls 34. These shelves are for storage of food packages and beverage bottles and to prevent these items from falling off the shelf 28 there is provided an elongated shelf front member 36 which extends from one side of the door 16 to the other side and is attached to each of the side walls 34 by means of end caps 38.

Figure 4:
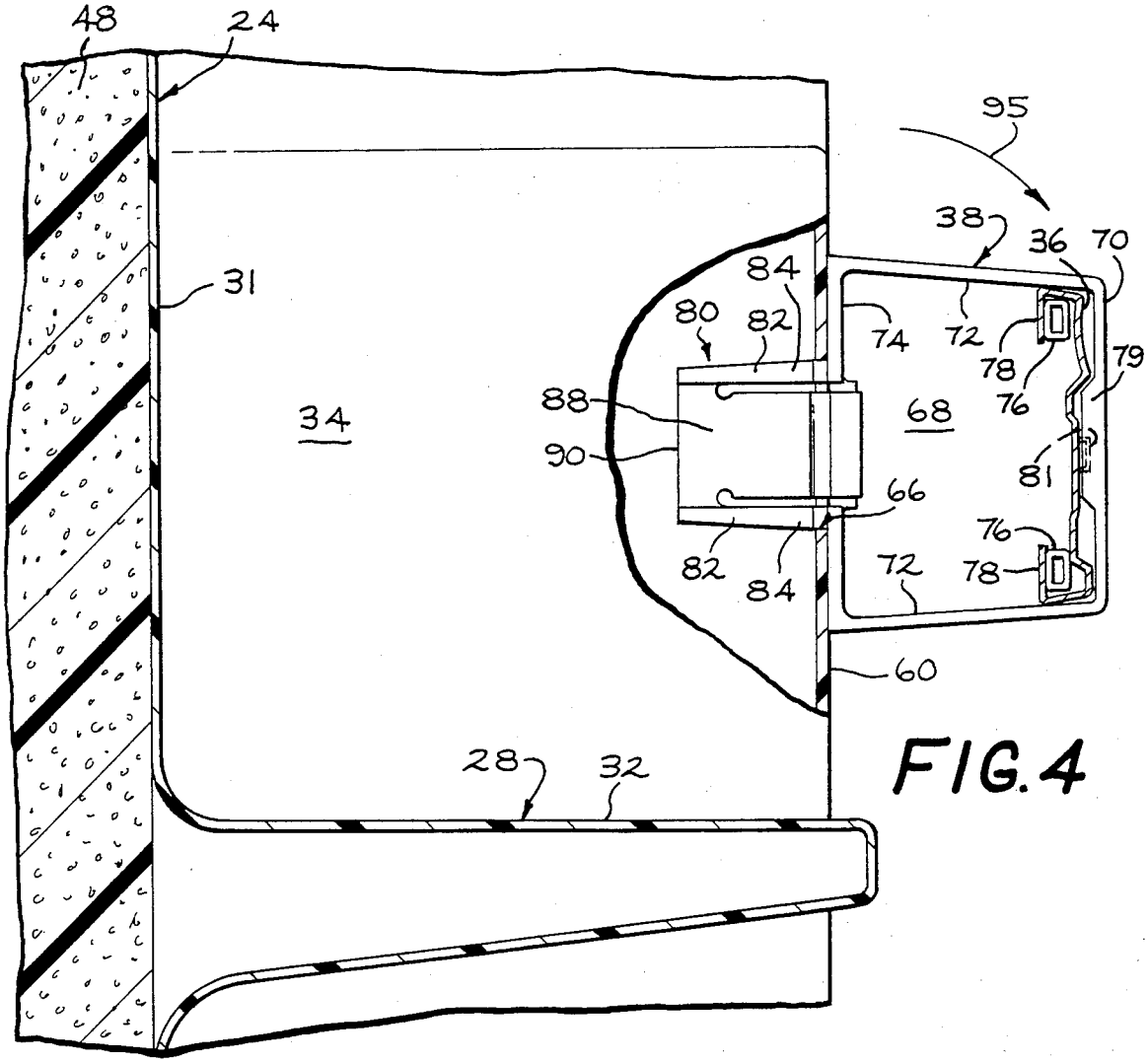
FIG. 4 is a side elevational view in section showing the shelf front assembly of the present invention.
Figure 2:
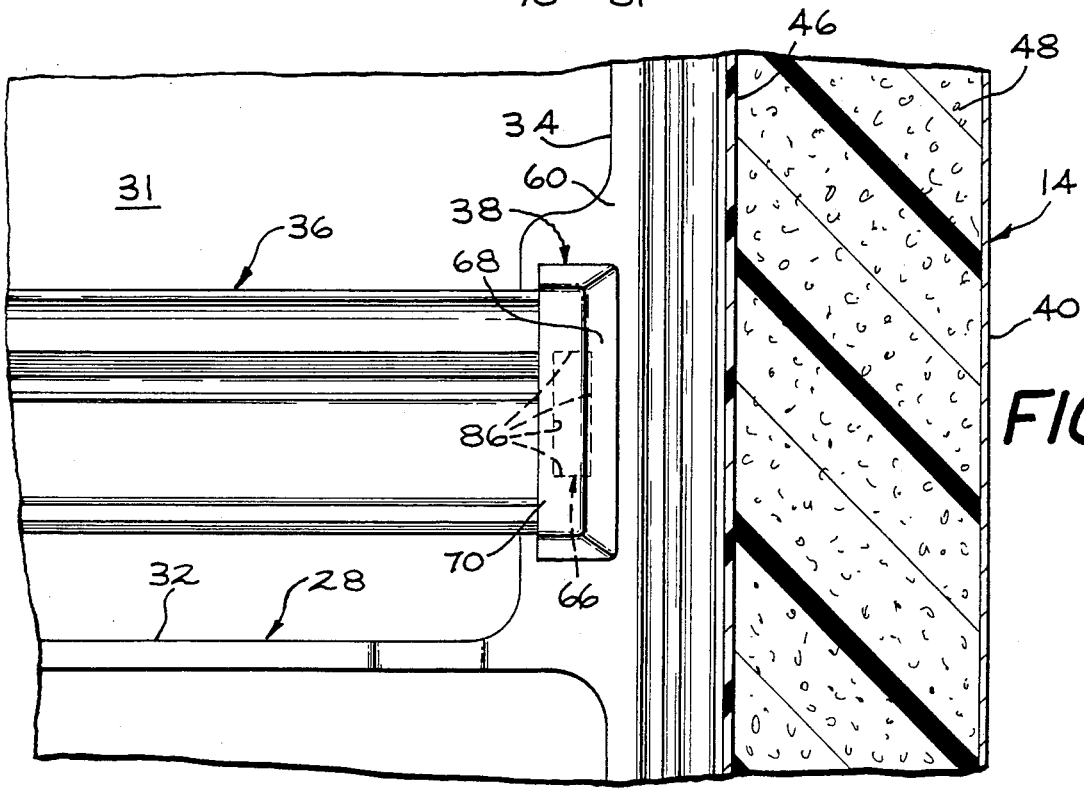
FIG. 2 is a front elevational view partially in section showing the shell, assembly of the present invention.

With reference to FIGS. 2–4, the shelf front assembly is shown in detail. As shown in FIG. 3, the fresh food door 16 is in its closed position and is sealed by a gasket assembly 22 to the refrigerator cabinet 14 which has an outer case 40 made of sheet metal which is formed to provide a front face 42 against which a gasket 41 seals and is held in place by a magnet 44 which is included in the gasket assembly 22. The cabinet 14 has an inner liner 46 which is secured to the outer case 40 at the periphery thereof and has thermal insulation 48 between the outer case 40 and the inner liner 46. The gasket assembly 22 is secured to the door 16 by any suitable gasket fastening means 50 which in the case of the preferred embodiment is an elongated channel member 52 secured by screws 53 to the door 16 which has snapped into it a dart projection 54 molded as part of the gasket 41 and is inserted through a slot into the elongated channel member and retained therein.

The door 16 has an inner door panel 24 usually molded from plastic material and secured to the outer sheet metal door 58. In the case of the preferred embodiment as shown in FIG. 3 the peripheral edge of the inner door panel 24 is held in place by the elongated channel member 52 which is fastened by screws into the outer door 58. Between the inner door panel 24 and the outer door 58 there is thermal insulation 26. The inner door panel 24 is formed to provide one or more shelves 28, which shelf is formed by a back wall 31, a bottom wall 32 and side walls 34. The inner door panel 24 has a front face 60 with a front surface 61 and a rear surface 63 which is perpendicular to the side wall 34 and there is a connecting section 62 which is essentially parallel to and spaced from the side wall 34. The connecting section 62 has a terminal peripheral end 64 which is secured to the outer door 58 by the elongated channel member 52. The front face 60 of the inner door panel 24 has a rectangular shaped aperture 66 into which is inserted a portion of the end cap 38.

As seen particularly in FIGS. 3 and 4, the end cap 38 which may have all the elements and members thereof integrally molded from suitable plastic material has a base wall 68, a front flange 70, side flanges 72, and rear flange 74, all of which depend perpendicularly from the base wall 68 in the same direction. The front of the base wall 68 has securing means such as securing projections 76 which are perpendicular to the base wall 68 and are dimensioned to receive in frictional engagement the shelf front member 36. To accomplish this the edges of the front member are bent into U-shaped sections 78 and are dimensioned to frictionally engage the securing projections 76 and be retained thereon. In addition the front flange 70 has an inwardly directed lip portion 79 and the shelf front member 36 has a bent tab 81 that engages the lip portion 79 to mechanically lock the shelf front member 36 to the end cap 38. Other suitable means for attaching the shelf front member 36 to the end cap 38 may also be used.

The end cap 38 has a latching assembly 80 which is attached to the rear flange 74 and projects rearwardly there from and is dimensioned to be receivable in the panel aperture 66 as shown in FIG. 4. The aperture 66 is rectangular shaped with the long sides of the aperture being vertically oriented and the short sides horizontally oriented (FIG. 2). There are two support legs 82 spaced from each other and the support legs are attached at one end 84 to the rear flange 74. The support legs have a width less than the length of the rear flange and slightly less than the distance between opposite edges 86 of the short sides of aperture 66 so that the support legs may be inserted through aperture 66. The support legs 82 are tapered between their attachment at one end to the rear flange 74 and their opposite end 90. The width of the legs at their opposite end 90 should be about half the distance between the long sides of the rectangular shaped aperture 66. The reason for such a structure is to easily accommodate insertion of the end cap latching assembly 80 including the support legs 82 into the aperture 66 by robotic means, thus allowing a simple straight in or single directional automated assembly of the end caps 38 and inner door panel 24. Straight in motion is also the most simple motion/time study movement for human manipulation as well and provide the fastest operator time and lowest labor cost for assembly. Many prior end cap structures such as the one disclosed in U.S. Pat. No. 3,652,032 require a person to manually secure the end caps to the inner door panel 24. In U.S. Pat. No. 3,652,032 the end cap must have one end (top end) inserted through the aperture by a straight in motion, then the end cap is moved upwardly to secure one end of the end cap to the upper part of the aperture. The end cap is then rotated about the secured top end that acts as a pivot point to engage the bottom of the aperture and continued rotational movement. The opposite (bottom) end of the end cap, which is a spring, will pass through the aperture and snap into engagement with the bottom edge of the aperture. As can be seen, such an operation is not automatable and takes a considerable amount of labor to install the end cap.

Figure 5:
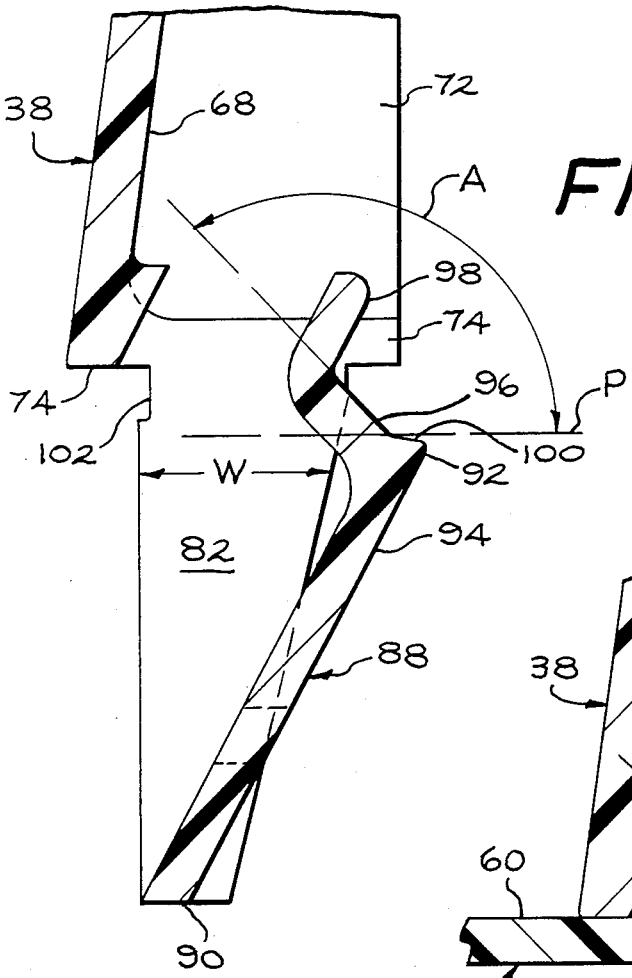
FIG. 5 is an enlarged view of a portion of the latching assembly of the shelf assembly of the present invention.
Figure 6:
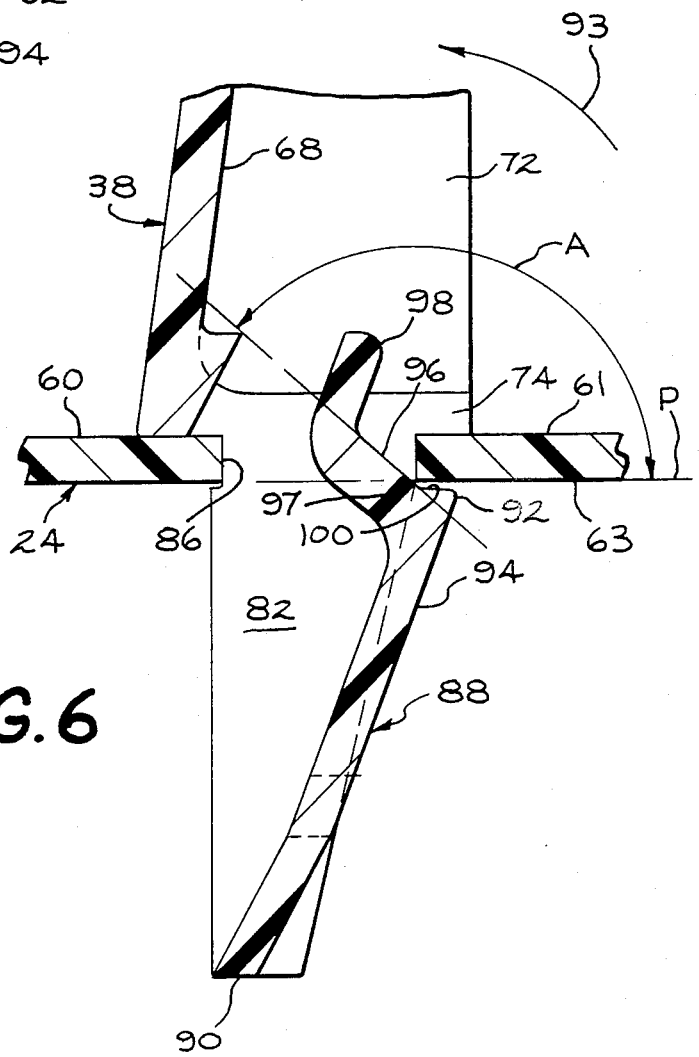
FIG. 6 is similar to FIG. 5 and showing the shelf front assembly of the present invention secured to a panel.

With particular reference to FIG. 5, the latching assembly of the present invention also includes a spring member 88 attached to the support legs 82 at one end 90 thereof away from the rear flange 74 and the distal end 92 of the spring member is free. The spring member 88 has an inclined ramp portion 94 extending from the attached one end 90 toward the rear flange 74 and extends outside the diameter of the aperture 66 between the long sides which is defined by the aperture edges 86 in the front face 60 of the inner door panel 24. The spring member 88 also has a sloped or inclined panel engaging portion 96 depending from the ramp portion 94 in the direction of the leg 82 when in its free state as shown in FIG. 5. The slope of the panel engaging portion 96 should be such that when the latching assembly 80 is fully inserted into the aperture 66 some portion of it will be biased against the rear surface 63 of the panel side wall at the bottom corner edge 97 of the aperture 66 as shown in FIG. 6. The reason for this arrangement is that in the event outwardly or downwardly directed force is applied to the elongated shelf front member 36 as by slamming the door with shelves containing stored beverages and food items, it has a tendency to rotate the end cap fastened to it in the direction of arrow 93 shown in FIGS. 3 and 6. Such force and/or moment applied to the shelf front member 36 is counteracted by an opposite force applied by the panel engaging portion 96 against the rear surface 63 of the inner door panel due to the panel engaging portion being spring biased against the rear surface 63 and in the opposite direction.

It has been found that the included angle between the panel engaging portion 96 and the rear surface 63 of the panel side wall 34 should be between 95 and 160 degrees when the spring member 88 is in its free state as shown in FIG. 5. The plane designated "P" in FIG. 5 represents the plane of the rear surface 63 of the panel side wall and the angle is designated "A" in FIG. 5. In the preferred embodiment angle "A" should be between 115 and 150 degrees as this range affords optimum performance for the purpose intended. It will be noted that the angle "A" is more when the latching assembly 80 is inserted in the aperture 66 as the spring member 88 is forced inwardly by the panel engaging portion 96 engaging the rear surface 63 at the bottom corner edge 97. The end of the panel engaging portion 96 away from the inclined ramp portion 94 may have a tab portion 98 which is used for depressing the spring member 88 as will be explained later. The spring member 88 has a shoulder 100 in the area of the junction between the ramp portion 94 and the panel engaging portion 96. The shoulder 100 departs the plane of the panel engaging portion 96 and in the preferred embodiment the plane of the shoulder is essentially parallel or at an acute angle (less than 90 degrees) to the rear surface 63 of the side wall 34 when the end cap is installed in the aperture 66 as shown in FIG. 6.

Because of tolerance variations in manufacturing, the thickness of the panel side wall can vary as much as 50 percent. The inner door panel including the side walls are vacuum formed from plastic material and to control the exact thickness from one panel to another is not possible. Therefore, it is desirable to have an end cap structure that can accommodate this variance in panel thickness and still provide a firmly and rigidly attached end cap over a range of panel thicknesses. For this reason, the panel engaging portion 96 is biased against only the rear surface 63 of the panel side wall 34. Prior art end caps commonly engaged both the front and rear surfaces of the panel and thus were not suitable to accommodate varying panel thicknesses. In some instances, they were too tight and very difficult to remove and in other instances too loose to give a firm rigid attachment.

With particular reference to FIG. 5, the support legs 82 each have a recess area 102. The end cap made in accordance with the above structure and particularly the portion including the latching assembly 80 as shown in FIG. 5 is secured to the inner door panel 4 by inserting one end 90 through the aperture 66 located in the front face 60 of panel 24 and inserting it until the rear flange 74 which has a dimension greater than the aperture 66 contacts the inner door panel 24 and thereby stops further movement of the end cap into the aperture 66. Upon movement of the latching assembly as described above the inclined ramp portion 94 engages the bottom corner edge 97 of the aperture 66 somewhere along the length of the inclined ramp portion 94 and by continued force of the end cap the spring member 88 is cammed inwardly against its spring bias force and allows passage of the spring member 88 through the aperture 66 whereupon the spring bias force of the spring member 88 will cause the spring member to move outwardly beyond the width of the aperture to the position shown in FIG. 6. When that happens the panel engaging portion 96 abuts the rear surface 63 of the panel side wall 34 at the bottom corner edge 97 of the aperture 66 as shown in FIG. 6 while the edge 86 on the opposite side of the aperture is received in recess 102 of the support leg which recess is dimensioned to be slightly larger than the maximum anticipated thickness of the panel 24 as shown in FIG. 6. In this manner then the end cap 38 is rigidly held in the aperture 66 by the spring bias force being exerted by the latching assembly exerting force against the rear surface 63 of the panel side wall. Should it be desired to remove the end cap from the inner door panel 24, the user may depress the tab portion 98 in the direction of the recess 102 (FIG. 5) of the support leg and overcome the spring bias force of the spring member 88, thus allowing the inclined ramp portion 94 to clear the edges 86 of the aperture and the end cap may be withdrawn from the panel by a straight out motion.

With reference again to FIG. 6, it will be noted that the position of the inserted end cap into the aperture 66 positions the latching assembly 80 such that the shoulder 100 in the area of the junction between the inclined ramp portion 94 and the panel engaging portion 96 is essentially parallel to the panel 56. As mentioned previously, it is desirable that the end cap be attached securely to the inner door panel 24 of a refrigerator door so that food items and beverage bottles that are placed on the shelf 28 will not dislodge the end cap from its secured position in the panel 58 when the door is slammed shut. Should such force be exerted on the shelf front member 36, it will be noted that the end caps 38 will resist displacement force by the shoulder portion 100 contacting the rear surface 63 of panel 24 and thereby prevent withdrawal of the end cap 38 from within the aperture 66 of the panel. The shoulder 100 may, of course, be at a more acute angle to the panel engaging portion 96 so long as it functions to engage the panel 24 and resist pull out force exerted on the end cap.

While, in accordance with the Patent Statute, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A shelf front assembly comprising:

a panel forming a shelf with a bottom wall and side walls, each said side wall having a front face with a rear surface and a front surface and having therethrough a rectangular shaped aperture having long and short sides with the long sides of the aperture being vertically oriented and the short sides horizontally oriented;

an elongated shelf front member, and an end cap removably secured to the panel, said end cap having;

a base wall with integrally formed rear, side and front flanges depending in the same direction therefrom, said base wall having at the front thereof means securing one end of the shelf front member, a latch assembly attached to the rear flange and projecting rearwardly therefrom and received in the panel side wall aperture, said latch assembly including;

two support legs attached at one end to the rear flange and having a width less than the length of the rear flange and slightly less than the distance between opposite edges of the short sides of the panel side wall aperture;

a spring member located between the support legs and attached to both support legs at one end thereof away from the rear flange and the distal end of the spring member is free, the spring member having an inclined ramp portion extending from the attached end toward the rear flange and extending outside the width of the aperture in the panel and a panel engaging portion depending from the ramp portion in the direction of the leg at an included angle with a plane representing the rear surface of the panel side wall when the end cap is installed in the panel aperture of between 95 and 160 degrees when the spring member is in its free state, said panel engaging portion being biased against only the rear surface of the panel side wall;

whereby upon depressing the spring member and inserting the latch assembly in the panel side wall aperture the rear flange abuts the front of the panel side wall at both long sides of said aperture and the panel engaging portion of the spring member is biased against the rear surface of the side wall adjacent the long side of the panel side wall aperture to secure the end cap to the panel.

2. The shelf front assembly of claim 1 wherein all elements and members of the end cap are integrally molded from plastic material.

3. The shelf front assembly of claim 1 wherein the spring member has a tab portion depending from the panel engaging portion for manually depressing the spring member to enable withdrawal of the end cap from the aperture.

4. The shelf front assembly of claim 1 wherein each leg has a recess in the area immediately adjacent the rear flange to receive the peripheral edge of the aperture.

5. The shelf front assembly of claim 1 wherein in the area of the junction between the ramp portion and panel engaging portion there is a shoulder departing the plane of the panel engaging portion at an angle such that the plane of the shoulder is essentially parallel to the rear surface of the side wall of the panel when the end cap is installed in the aperture.

6. The shelf front assembly of claim 1 wherein the included angle between the panel engaging portion and the plane representing the rear surface of the panel side wall when the cap is installed in the panel aperture is between 115 and 150 degrees when the spring member is in its free state.

7. The shelf front assembly of claim 1 legs are tapered between their attachment at one end to the rear flange and their opposite end.

8. The shelf front assembly of claim 7 wherein the width of said opposite ends of the support legs are approximately half the distance between the long sides of the rectangular shaped aperture.

* * * * *

UNITED STATES PATENT AND TRADEMARK OFFICE

CERTIFICATE OF CORRECTION

PATENT NO. : 4,815,685

DATED : March 28, 1989

INVENTOR(S) : John J. Roberts/Richard A. Stich/John M. Powell
Gerhard K. Losert

It is certified that error appears in the above-identified patent and that said Letters Patent is hereby corrected as shown below:

Claim 7, line 1, after "1" insert --wherein the support--.

Signed and Sealed this

Thirty-first Day of October, 1989

*Attest:*

DONALD J. QUIGG

*Attesting Officer*

*Commissioner of Patents and Trademarks*